US005147418A

United States Patent [19]

Laverman et al.

[11] Patent Number: 5,147,418

[45] Date of Patent: Sep. 15, 1992

[54] VOLATILE LIQUID STORAGE SYSTEM

[75] Inventors: Royce J. Laverman, South Holland; Philip J. Winters, Lockport; Jeffrey K. Rinehart, Naperville, all of Ill.

[73] Assignee: Chicago Bridge & Iron Technical Services Company, Oak Brook, Ill.

[21] Appl. No.: 810,294

[22] Filed: Dec. 19, 1991

[51] Int. Cl.[5] ..... B01D 53/04; B01D 50/00

[52] U.S. Cl. ..... 55/18; 55/57; 55/74; 55/179; 55/218; 55/387; 220/227

[58] Field of Search ..... 55/18, 57, 58, 62, 74, 55/161, 179, 180, 208, 210, 218, 387; 62/18; 220/202, 216, 227, 331, 367, 371

[56] References Cited

U.S. PATENT DOCUMENTS

| | | | |
|---|---|---|---|
| 1,439,451 | 12/1922 | Seibert et al. | 55/179 X |
| 1,566,944 | 12/1925 | Wilson | 55/62 |
| 1,611,440 | 12/1926 | Haupt | 220/216 |
| 2,316,251 | 4/1943 | Kahle et al. | 55/62 X |
| 2,461,537 | 2/1949 | Feild | 220/216 X |
| 2,611,511 | 9/1952 | Wissmiller | 55/57 X |
| 2,718,977 | 9/1955 | Wiggins | 220/227 |
| 2,829,795 | 4/1958 | Moyer | 220/26 |
| 2,965,196 | 12/1960 | Rich Jr. | 55/179 X |
| 2,968,420 | 1/1961 | Harris et al. | 220/26 |
| 3,075,668 | 1/1963 | Reese | 220/26 |
| 3,120,320 | 2/1964 | Wissmiller | 220/26 |
| 3,136,444 | 6/1964 | Moyer | 220/26 |
| 3,867,111 | 2/1975 | Knowles | 55/58 X |
| 3,902,874 | 9/1975 | McAndrew | 55/180 X |
| 3,918,932 | 11/1975 | Lee et al. | 55/62 |
| 3,972,201 | 8/1976 | Datis | 62/54 |
| 3,979,175 | 9/1976 | Kattan et al. | 431/5 |
| 4,025,324 | 5/1977 | Stackhouse, Jr. et al. | 55/179 |
| 4,066,423 | 1/1978 | McGill et al. | 55/58 X |
| 4,243,151 | 1/1981 | Bruening | 220/216 |
| 4,261,716 | 4/1981 | Schwartz et al. | 55/179 X |
| 4,353,477 | 10/1982 | Bruening | 220/224 |
| 4,391,705 | 7/1983 | Cook et al. | 220/227 X |
| 4,392,870 | 7/1983 | Chieffo et al. | 55/179 X |
| 4,966,611 | 10/1990 | Schumacher et al. | 55/179 X |
| 4,995,890 | 2/1991 | Croudace | 55/180 |
| 5,017,240 | 5/1991 | Brown | 55/62 X |

*Primary Examiner*—Robert Spitzer

*Attorney, Agent, or Firm*—Marshall, O'Toole, Gerstein, Murray & Bicknell

[57] ABSTRACT

A volatile liquid storage and emissions control apparatus and method comprising an above-ground volatile liquid storage tank having a bottom, a vertical circular wall and an external fixed roof, the tank having an internal floating roof, and air vents in the tank wall; an emissions collection apparatus comprising a conduit having an emissions laden air inlet end communicating with the tank vapor space and an emissions laden air outlet end communicating with the inlet end of an emissions abatement apparatus, with the conduit including a pump for withdrawing emissions laden air from the tank vapor space and feeding it into the emissions abatement apparatus, and the emission abatement apparatus being capable of eliminating most of the emissions from the emissions laden air with formation of a gaseous effluent which is discharged to the atmosphere.

23 Claims, 3 Drawing Sheets

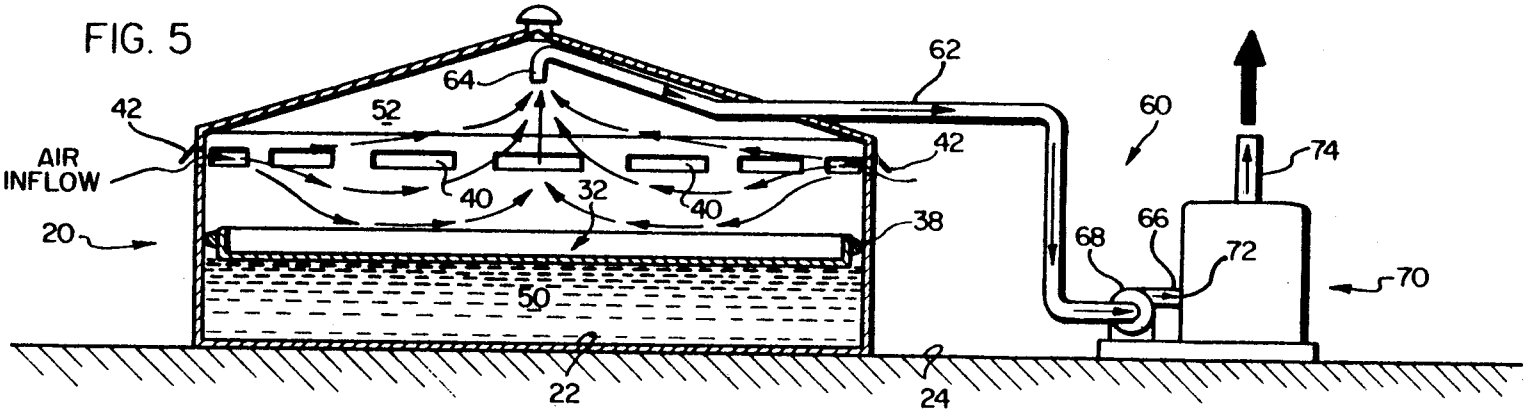
FIG. 5
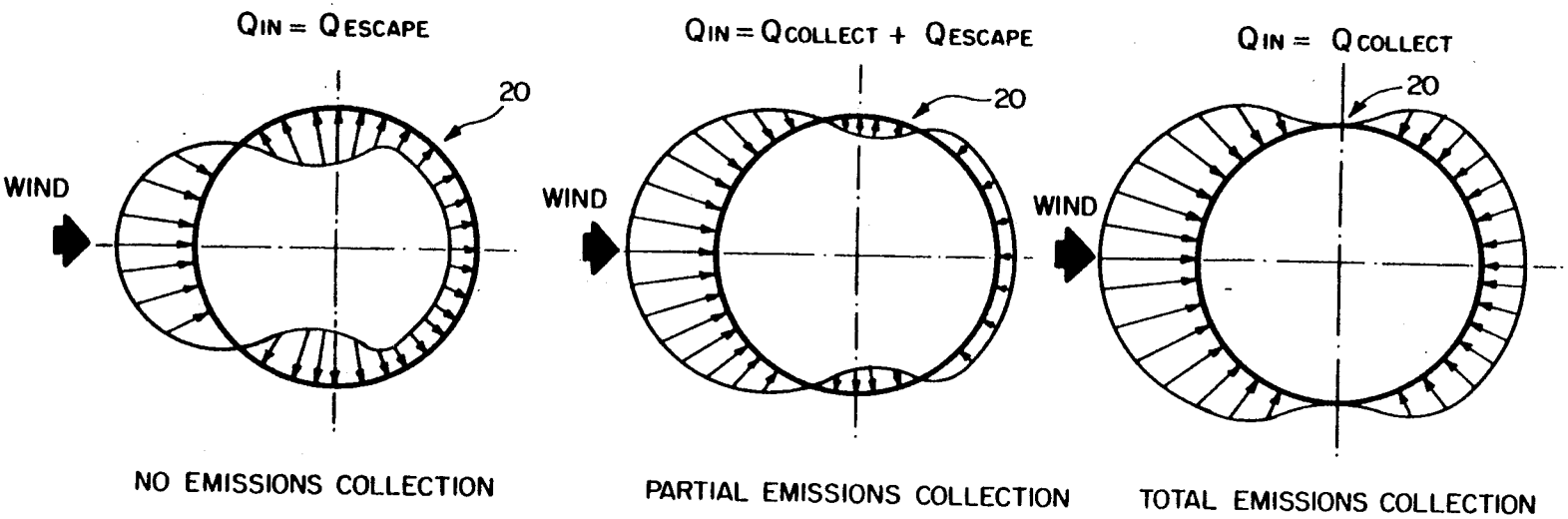
FIG. 4
FIG. 6
FIG. 7

VOLATILE LIQUID STORAGE SYSTEM

This invention relates to apparatus and methods of storing a volatile liquid, the collection of emissions from the volatile liquid and their substantial or partial abatement to avoid or greatly minimize environmental pollution.

BACKGROUND OF THE INVENTION

Ambient air quality has become an increasingly important concern in recent years. Many air pollutant emission sources that were tolerated in years past are now facing regulations which force significant reductions or elimination of such emissions. One category of such emission sources is above-ground storage tanks for volatile liquids.

Although there are other types of above-ground volatile liquid storage tanks, one type of such tank in wide use is referred to as an internal floating-roof tank. This type of tank has a circular essentially flat bottom, a vertical cylindrical circular wall having a lower edge portion joined to the bottom and an external fixed roof joined to an upper portion of the tank wall. The tank has an internal floating roof adapted to float on a volatile liquid stored in the tank. The rim space between the floating roof periphery and the tank wall is sealed by one of several types of sealing means attached to and movable vertically simultaneously with the floating roof so as to reduce emissions into the tank vapor space between the floating roof, fixed roof and the tank wall. Some such seals are disclosed in the U.S. Pat. Nos.: Moyer 2,829,795; Harris et al. 2,968,420; Reese 3,075,668; Wissmiller 3,120,320; Moyer 3,136,444; and Bruening 4,406,377.

The tank fixed roof ca be wholly supported by the tank wall or it can be partially supported by the tank wall and partially supported by vertical columns in the tank. Since such columns must penetrate the floating roof, the holes in the floating roof are provided with seals to minimize flow of emissions through the holes into the tank vapor space. Bruening U.S. Pat. No. 4,243,151 discloses such a sealing system.

The described tank also has air vent means, generally positioned in the tank wall so as to be in communication with the tank vapor space when the floating roof floats on a predetermined maximum volume of volatile liquid in the tank.

The air vent means can comprise a multiplicity of spaced apart vent holes. Air flows inwardly into the tank vapor space through a portion of these vent holes dependent on ambient wind speed conditions. As the air flows in, the air mixes with emissions in the tank vapor space. The air laden with emissions then flows outwardly from the tank vapor space through the remainder of these vent holes into the ambient air, resulting in atmospheric emissions.

The air vent means can also comprise a single vent opening of essentially uniform width extending around substantially the entire circumference of the tank wall. Air flows inwardly into the tank vapor space through a portion of this vent opening that extends over part of the circumferential length of the vent opening dependent on ambient wind speed conditions. As the air flows in, the air mixes with emissions in the tank vapor space. The air laden with emissions then flows outwardly from the tank vapor space through the remaining circumferential length of the vent opening into the ambient air, resulting in atmospheric emissions.

American Petroleum Institute Standard 650, Appendix H, describes the venting requirements for internal floating-roof tanks. This standard requires that shell vents be provided which have a total vent area, A, of 0.2 square feet of vent area per foot of tank diameter, with a minimum of four shell vents. The maximum spacing between shell vents may not exceed 32 feet. In addition, a roof vent of 50 square inches minimum area is required on the fixed roof.

The combination of shell vents and roof vent provide sufficient natural ventilation of the tank vapor space to minimize the possibility of creating a combustible mixture in the tank vapor space for volatile liquids with a vapor pressure up to 11.0 pounds per square inch absolute. Thus, internal floating.roof tanks inherently provide a high degree of safety in service for the storage of volatile liquids.

The emissions may be divided into standing storage emissions and working emissions. Standing storage emissions are the evaporative loss of volatile liquid stock vapor that occurs without any change in the liquid level in the tank. These emissions result from the floating roof rim seal system, floating roof fittings and floating roof seams, if not welded. Working emissions are the evaporative loss of stock vapor resulting from a decrease in liquid level in the tank. As stock is withdrawn from the tank and the floating roof descends, stock clings to the inside surface of the tank wall and evaporates into the tank vapor space. All emissions first accumulate in the tank vapor space, where they mix with ventilation air that enters the tank vapor space through a portion of the air vent means which can comprise some of the wall vent holes. Secondly, the emissions laden air leaves the tank vapor space through the remaining portion of the air vent means which can comprise the remaining wall vent holes, resulting in the emissions entering the atmosphere. It is the release of such emissions to the atmosphere which must be reduced or eliminated to comply with expected regulations reducing environmental pollution.

SUMMARY OF THE INVENTION

According to one aspect of the invention, a volatile liquid storage and emissions control apparatus is provided comprising an above-ground volatile liquid storage tank having a bottom, a vertical cylindrical circular wall having a lower edge portion joined to the bottom, and an external fixed roof, the tank having an internal floating roof adapted to float on a volatile liquid to be stored in the tank, and air vent means in the tank located in communication with a vapor space in the tank constituting at least the space above the floating roof when the floating roof floats on a predetermined maximum volume of volatile liquid in the tank; the air vent means permitting air to flow inwardly into the tank vapor space at an air flow rate under specified ambient wind speed conditions and tank operating conditions; an emissions collection apparatus comprising a conduit having an emissions laden air inlet end communicating with the tank vapor space above the floating roof when the floating roof floats on a maximum volume of volatile liquid and an emissions laden air outlet end communicating with the inlet end of an emissions abatement apparatus, with said conduit including an induced draft blower for withdrawing emissions laden air from the tank vapor space and feeding it into the emissions abatement apparatus while simultaneously having air flow inwardly through the air vent means into the tank vapor space; and the emissions abatement apparatus comprising means for eliminating most of the emissions from the emissions laden air with formation of a gaseous effluent and discharging the resulting gaseous effluent to the atmosphere.

Desirably the air vent means is sized so that air can flow inwardly through the air vent means into the tank vapor space at an air flow rate under specified natural wind speed conditions and tank operating conditions which does not exceed production of a mixture of air and emissions greater than a predetermined amount. The phrase "predetermined amount" includes a predetermined volume of the mixture as well as a predetermined flow rate of the mixture. The volume of the mixture of air and emissions perhaps has more relevance to use of an abatement apparatus using, as an example, activated carbon to remove the emissions from the mixture while the mixture flow rate is likely more applicable when the abatement apparatus relies, as an example, on incineration to destroy the emissions in the air-emissions mixture.

The air vent means can comprise a multiplicity of spaced apart vent holes in the tank wall sized and positioned so that air can flow inwardly through the vent holes into the tank vapor space.

The air vent means can also comprise a gap, desirably of uniform height, between the upper edge of the tank wall and the fixed roof. Such a gap can be provided by supporting the fixed roof above the upper edge of the tank wall by vertical spaced apart metal bars or strips. The lower end of each bar can be joined to the tank wall and the upper end of each bar can be joined to the fixed roof.

The tank wall can have a plurality of circumferentially positioned equally spaced apart continuously open vent holes around the wall. All of the wall vent holes can be about the same size and shape and they can be located near the top of the tank wall in about a circumferential horizontal line.

The emissions collection apparatus can be sized so that, for all ambient wind speed conditions below a specified maximum and for specified tank operating conditions of standing storage and tank working, air will flow inwardly through the entire air vent means, whether holes in the tank wall or a gap between the wall upper edge and the roof, into the tank vapor space. Furthermore, the emissions collection apparatus can be sized so that the air flow rate into the tank vapor space is an approximate minimum needed to achieve a predetermined level of emissions collection so as to avoid unnecessarily increasing the size of the emissions abatement apparatus. Additionally, the emissions collection apparatus can be sized so that air can flow only inwardly through the wall vent means into the tank vapor space so as to collect all emissions under all anticipated ambient wind speed conditions and tank operating conditions.

The wall vent means can be sized and shaped so that a sufficient amount of air enters the tank vapor space when the emissions collection apparatus is not in operation so as to produce a noncombustible mixture in the tank vapor space.

The external fixed roof can have a roof vent which is capable of closing when the emissions collection apparatus is in operation and of opening when the emissions collection apparatus is not is operation.

The emission abatement system can include incineration means, refrigeration means, absorption means or adsorption means, to remove most of the emissions from the emissions laden air that is collected by the emissions collection apparatus.

According to a second aspect of the invention, a method of collecting and abating emissions from a volatile liquid in an above-ground storage tank is provided in which the liquid storage tank has a bottom, a vertical cylindrical circular wall having a lower edge portion joined to the bottom, and an external fixed roof, the tank having an internal floating roof floating on a volatile liquid stored in the tank, and air vent means in the tank in communication with a vapor space in the tank constituting at least the space above the floating roof when the floating roof floats on a predetermined maximum volume of volatile liquid in the tank; permitting ambient air to flow inwardly through the air vent means into the tank vapor space at an air flow rate under specified ambient wind speed conditions and tank operating conditions; pumping emissions laden air from the tank vapor space above the floating roof by a conduit having an inlet end communicating with the tank vapor space, an outlet end communicating with the inlet end of an emissions abatement apparatus, and a pump means in the conduit for effecting said pumping and thereby delivering the emissions laden air to the emissions abatement apparatus, while simultaneously having air flow inwardly through the air vent means into the tank vapor space; and by means of the emissions abatement apparatus eliminating most of the emissions from the emissions laden air with formation of a gaseous effluent and then discharging the resulting gaseous effluent to the atmosphere.

In practicing the method, the air vent means can comprise a multiplicity of spaced apart air vent holes in the tank wall sized and positioned so that air can flow inwardly through the air vent holes into the tank vapor space.

Also, the method can be practiced using a tank in which the air vent means comprises a gap, desirably of uniform height, between the upper edge of the tank wall and the fixed roof. Such a gap can be provided by supporting the fixed roof above the upper edge of the tank wall by vertical spaced apart metal bars or strips. The lower end of each bar can be joined to the tank wall and the upper end of each bar can be joined to the fixed roof.

Desirably, the method includes controlling the ambient wind flow inwardly through the air vent means into the tank vapor space so that at an air flow rate under specified ambient wind speed conditions and tank operating conditions the mixture of air and emissions produced in the tank is not greater than a predetermined amount which the emissions abatement apparatus size or capacity can handle to remove, treat or destroy the emissions. The phrase "predetermined amount" includes a predetermined volume of the mixture as well as a predetermined flow rate of the mixture. The volume of the mixture of air and emissions perhaps has more relevance to use of an emissions abatement apparatus using activated carbon, as an example, to remove the emissions from the mixture while the mixture flow rate is likely more applicable when the emissions abatement apparatus relies primarily on incineration, as an example, to destroy the emissions in the air-emissions mixture.

The air can flow into the tank vapor space through a plurality of circumferentially positioned equally spaced apart continuously open vent holes in and around the tank wall. All of the vent holes can be about the same size and shape and be located near the top of the tank wall in about a circumferential horizontal line.

The emissions laden air can be fed to an emissions collection apparatus sized so that, for all ambient wind speed conditions below a specified maximum and for specified tank operating conditions of standing storage and tank working, air flows inwardly through the entire, or all of the, air vent means into the tank vapor space. Desirably, the emissions laden air can be fed to an emissions collection apparatus sized so that the air flow rate into the tank vapor space is an approximate minimum needed to achieve a predetermined level of emissions collection so as to avoid unnecessarily increasing the size of the emissions abatement apparatus. In another embodiment, the emissions laden air can be fed to an emissions collection apparatus sized so that air will flow only inwardly through the tank air vent means into the tank vapor space so as to collect all emissions under all anticipated ambient wind speed conditions and tank operating conditions.

The air flow rate into the tank vapor space can be regulated by having the air vent means sized and shaped so that a sufficient amount of air enters the tank vapor space to produce a noncombustible mixture when the emissions collection apparatus is not in operation.

When the emissions collection apparatus is in operation, a roof vent in the external fixed roof can be closed and when the emissions collection apparatus is not in operation, said roof vent can be open.

The described method can be practiced using one or more emissions abatement apparatus such as an incineration means, a refrigeration means, an absorption means or an adsorption means, to remove most of the emissions from the emissions laden air that is collected by the emissions collection apparatus.

BRIEF DESCRIPTION OF THE DRAWINGS

FIG. 4 illustrates the pattern of tank wall vent hole air flow rates at a constant ambient wind speed during standing storage when there is no collection of tank vapor space emissions;

FIG. 5 illustrates schematically a complete apparatus provided by the invention;

FIG. 6 illustrates the pattern of tank wall vent hole air flow rates at a constant ambient wind speed during standing storage when there is partial collection of tank vapor space emissions;

FIG. 7 illustrates the pattern of tank wall vent hole air flow rates at a constant ambient wind speed during standing storage when there is total collection of tank vapor space emissions.

DETAILED DESCRIPTION OF THE INVENTION

To the extent it is reasonable and practical, the same elements which appear in the various drawing figures will be identified by the same numbers.

Figure 1:
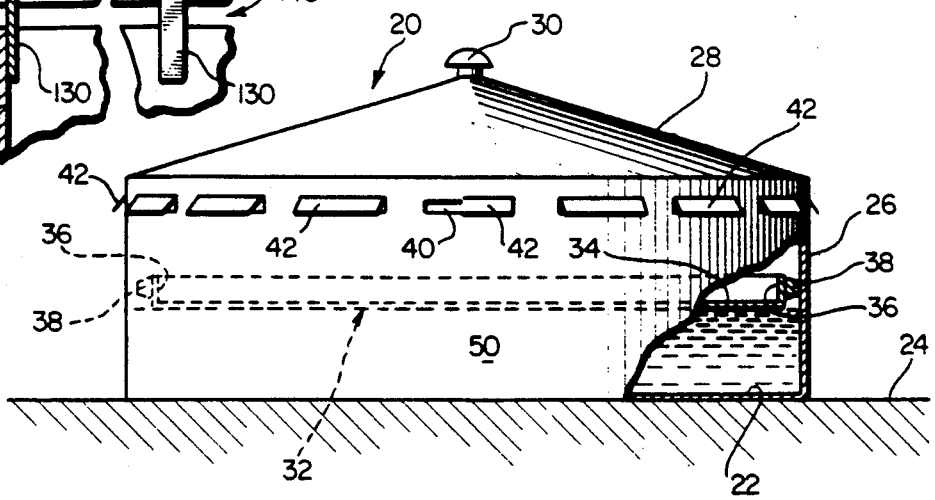
FIG. 1 is an elevational view of an internal floating-roof tank.
Figure 2:
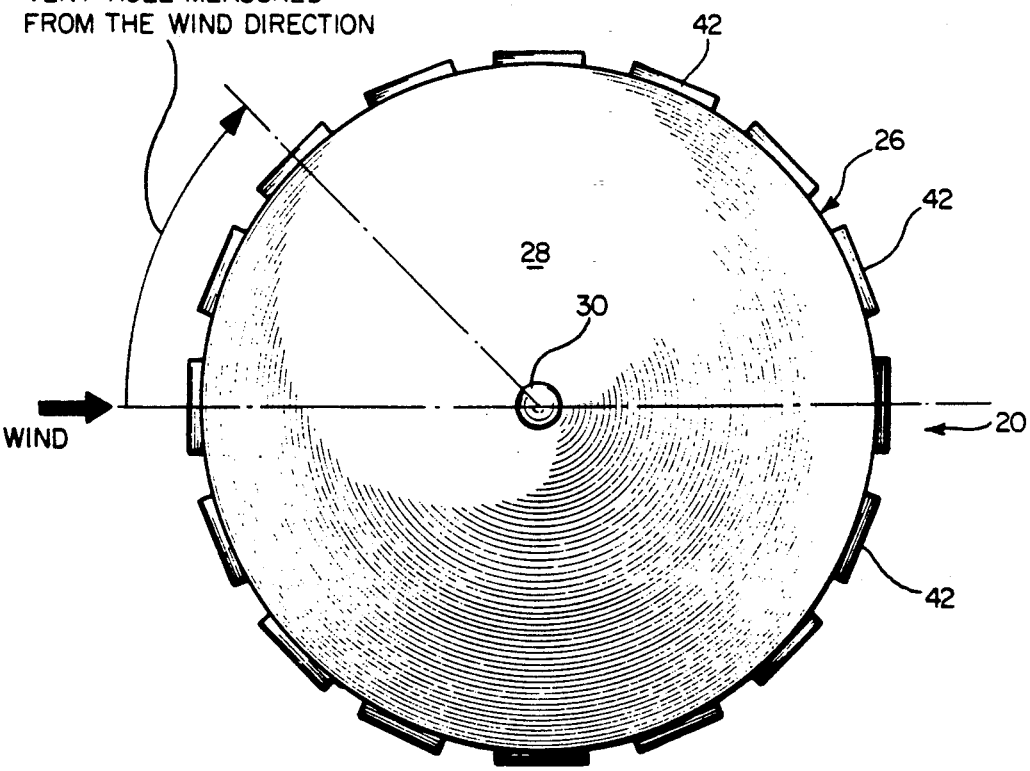
FIG. 2 is a plan view of the tank shown in FIG. 1.

The internal floating roof tank itself 20 illustrated by FIGS. 1 and 2 is of conventional construction and it has a flat circular bottom 22 which rests on a suitable foundation 24 supported above ground level. The lower edge of cylindrical circular tank wall 26 is joined to the bottom 22. Fixed roof 28 is joined to the upper end or edge of wall 26 and is thereby fully supported without the use of internal columns. Roof vent 30 is positioned at the apex of fixed roof 28 and it permits emissions laden air to flow from the tank vapor space located beneath the fixed roof 28 and above the internal floating roof 32. The roof vent 30 is open in a conventional prior art tank.

The floating roof 32 has a flat deck 34 and a vertical circular rim 36 around the deck. A seal in the form of a resilient polymeric foam ring 38 is secured to the outer vertical surface of rim 36 so that the foam ring 38 moves with the deck 34 but continually contacts the inner surface of tank wall 26. Although one embodiment of floating roof and rim space seal has been illustrated and described, other types are disclosed in the prior art and may be used in this invention. See for example the U.S. patents identified previously herein.

The tank wall 26 (FIGS. 1 and 2) has a plurality of spaced apart tank wall vent holes 40 located in a horizontal peripheral line around the tank. A sloping plate 42 may be positioned above each tank wall vent hole 40 to deflect rain and keep it from flowing and blowing into the tank 20.

The tank 20 can be used to store a wide variety of volatile liquid products 50 such as gasoline, jet engine fuel, kerosene, highly volatile liquid hydrocarbons and other flammable materials, many of which become combustible when mixed with the right amount of air.

The disadvantage of a tank 20 when used to store a volatile liquid product is that it permits stored product emissions to mix with the air and form a mixture in the tank vapor space which when vented to the atmosphere causes pollution of the atmosphere which while often not high is becoming unacceptable even at low levels.

Figure 3:
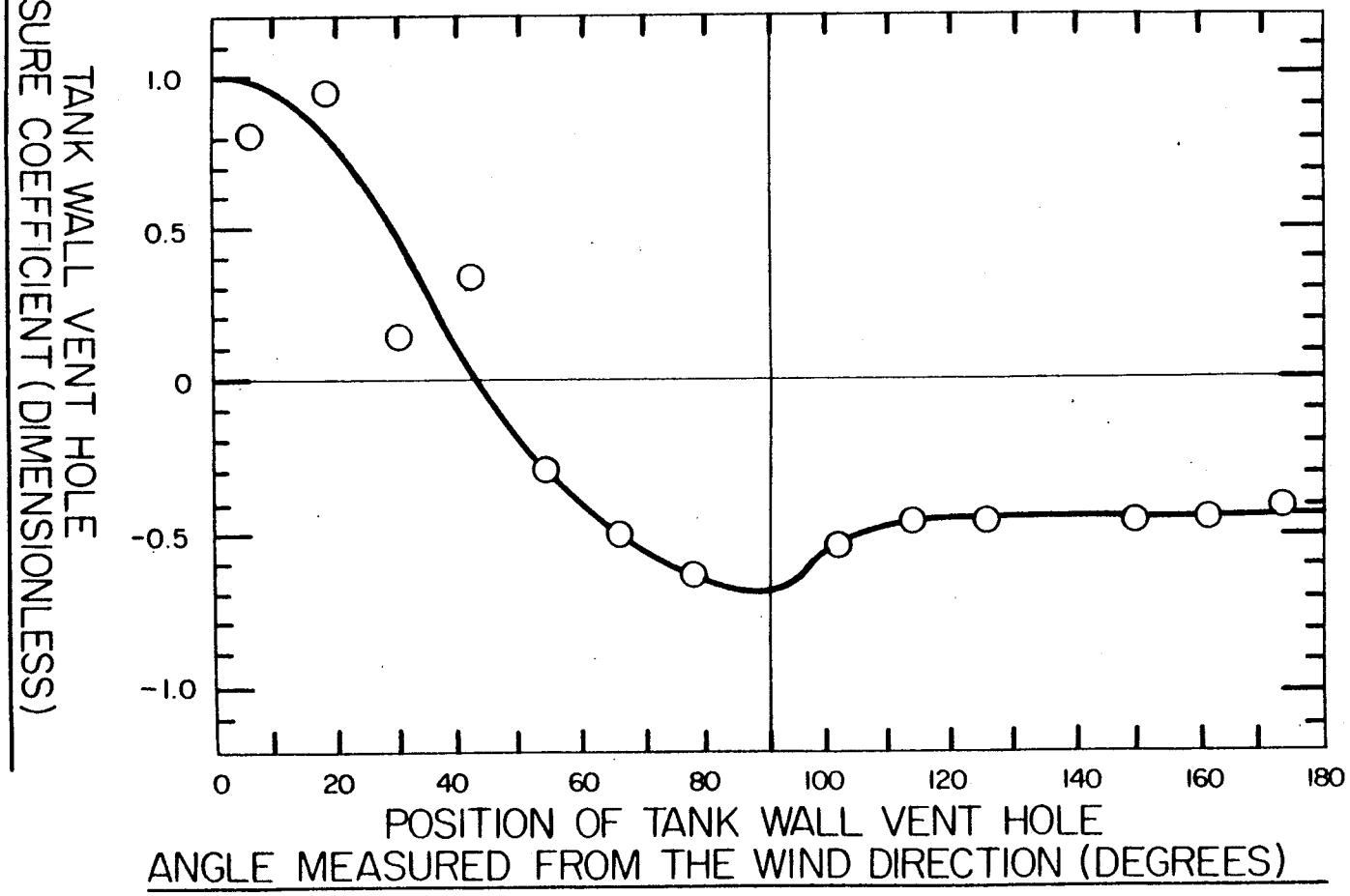
FIG. 3 is a graph of measured tank wall vent hole pressure coefficients, $C_P$, versus the position of the tank wall vent holes as measured by an angle from the wind direction shown in FIG. 2.

A wind tunnel test has been conducted on a tank model having a structure generally like that illustrated in FIGS. 1 and 2 to determine the tank vapor space ventilation characteristics of such a tank. The test measured the tank wall vent hole 40 pressure coefficients, $C_P$, which were then graphed or plotted against the position of the wall vent hole as measured by an angle from the wind direction shown in FIG. 2. FIGS. 1 and 2 show the tank wall vent hole orientation relative to the wind direction. FIG. 3 constitutes the resulting graph or plot.

The air flow rate, $q_V$, through a tank wall vent hole may be determined from Equation 1:

$$q_V = 88.0 C_D A_V V (C_P - C_{PT})^{\frac{1}{2}} \quad (1)$$

where:

$q_V$=air flow rate through a tank wall vent hole, (cubic feet per minute).

$C_D$=discharge coefficient of a tank wall vent hole, (dimensionless).

$A_V$=flow area of a tank wall vent hole, (square feet).

V=ambient wind speed, (miles per hour).

$C_P$=pressure coefficient on the outside of the tank wall at the location of a tank wall vent hole, (dimensionless).

$C_{PT}$=pressure coefficient inside the tank vapor space, (dimensionless).

The wind tunnel test determined that the pressure coefficient inside the tank vapor space, $C_{PT}$, was −0.342 for the case where there is no collection of tank vapor space emissions.

The discharge coefficient, $C_D$, of the tank wall vent hole depends upon the construction features of the vent hole such as the possible use of a sloping plate to deflect rain. Measurements of the discharge coefficient, $C_D$, of a tank wall vent hole of the construction shown in FIGS. 1 and 2 resulted in a value of 0.570.

FIG. 3 shows that the tank wall vent hole pressure coefficient, $C_P$, is the largest at 0°, resulting in the maximum air flow rate through the tank wall vent hole at that location into the tank vapor space. The tank wall vent hole pressure coefficient decreases as the angle increases around the tank wall to a value of −0.342 at a location which is at an angle approximately 56.5° from the wind direction. At that location the tank wall vent hole pressure coefficient, $C_P$, is the same as the tank vapor space pressure coefficient, $C_{PT}$, for the case where there is no collection of tank vapor space emissions, resulting in essentially no air flow through the tank wall vent hole at that location. As one moves further around the tank wall, the tank wall vent hole pressure coefficient, $C_P$, decreases to a minimum negative value of approximately −0.675, which occurs at an angle of 90° from the wind direction. At this location, the air flow rate is at a maximum from the tank vapor space through the tank wall vent hole, to the ambient air. As one continues around the tank wall, the tank wall vent hole pressure coefficient, $C_P$, remains less than −0.342, indicating that the flow is outward through the tank wall vent holes. This pattern of air flow through the wall vent holes is also shown in FIG. 4 which represents the condition where there is no collection of tank vapor space emissions. The length and direction of the arrows in FIG. 4 is related to the air flow rate and direction through the tank wall vent holes.

For the case where there is no collection of tank vapor space emissions, the tank vapor space pressure coefficient, $C_{PT}$, is −0.342 and Equation 1 may be integrated over the entire number of tank wall vent holes by using the measured tank wall vent hole pressure coefficients, $C_P$, that are shown in FIG. 3. Equation 2 is the resulting relationship which may be used to determine the total air flow rate, $q_W$, into the tank vapor space due to ventilation by the ambient wind during standing storage.

$$q_W = 22.9 C_D A D V \quad (2)$$

where:

$q_W$=total air flow rate into the tank vapor space through the tank wall vent holes due to ventilation by ambient wind during standing storage, (cubic feet per minute).

$C_D$=discharge coefficient of a tank wall vent hole, (dimensionless).

A=flow area of the tank wall vent holes, (square feet per foot of tank diameter).

D=tank diameter, (feet).

V=ambient wind speed, (miles per hour).

Referring now to FIG. 5, this drawing illustrates one embodiment of the apparatus provided by the invention and the use of the apparatus in practicing the method aspect of the invention.

The apparatus shown in FIG. 5 includes a conventional internal floating roof tank 20, as previously described and illustrated in FIGS. 1 and 2 so the details of the tank will not be described again. However, the tank wall vent holes 40 should be designed such that they are capable of maintaining a noncombustible gas mixture in the tank vapor space during periods when the emissions collection apparatus is not in operation. The size of such tank wall vent holes should advisedly be kept to a minimum so that the emissions collection apparatus and emissions abatement apparatus subsequently described are not forced to be unnecessarily large.

It is possible in some cases to use less tank wall vent hole area, A, than is required by API Standard 650, Appendix H, and still be able to maintain the air/vapor mixture noncombustible in the tank vapor space.

The roof vent 30 located near the apex of the fixed roof should advisedly be capable of closing when the emissions collection apparatus is in operation and opening when the emissions collection apparatus is not in operation.

The tank 20 will be seen in FIG. 5 to be fitted with an emissions collection apparatus 60 comprising a conduit 62 which penetrates the tank 20 and has an emissions laden air inlet end 64 communicating with the center of the tank vapor space 52 above the floating roof 32 where it can provide an effective single collection point for the emissions laden air. However, it may be desirable in certain cases to provide multiple inlets to conduit 62. Multiple inlets could be tied into a single outlet conduit 62. The conduit 62 also has an emissions laden air outlet end 66 communicating with the inlet end 72 of an emissions abatement apparatus 70. A pump means, desirably an induced draft blower 68, is included in conduit 62 to lower the pressure in the tank vapor space 52 and draw the emissions laden air into the conduit 62 and feed it to the emissions abatement apparatus 70.

The emissions collection apparatus is to be sized so that the air flow rate is such that under all specified ambient wind speed conditions and tank operating conditions, air flows inwardly through the tank wall vent holes into the tank vapor space 52. It is important that the air flow rate not exceed the amount required to achieve the specified level of emissions collection since this would unnecessarily increase the size of the emissions abatement apparatus 70. The pump or blower 68, and the conduit inlet 64 are sized using tank wall vent hole pressure coefficient, $C_P$, data.

FIG. 6 illustrates typical tank wall vent hole air flow rates for partial emissions collection but at a constant ambient wind speed during standing storage equal to that applicable to the air flow used in developing FIG. 4. It can be seen in FIG. 6 that air flows into the tank vapor space 52 over a greater number of tank wall vent holes than when no emissions are collected as shown in FIG. 4.

In some environmental control applications, partial collection may be adequate. For example, if the objective is to provide an emission reduction system to limit the ground level concentration of emissions to a specific maximum value at a specified distance from the storage tank 20, then it is permissible to emit some emissions through the tank wall vent holes 40 at higher ambient wind speeds, since the ambient wind will disperse and dilute these emissions and result in an acceptable ground level concentration.

FIG. 7 applies to use of the invention in achieving total emissions collection. Although some tank wall vent holes 40 have higher air flow rates into the tank vapor space 52, there is no air flow out of the tank vapor space 52 with this air flow rate of collection. This is preferred since all emissions in the tank vapor space 52 are collected up to a design ambient wind speed. This design ambient wind speed will be determined based on anticipated meteorological conditions, local air quality requirements, specific storage tank information and other factors.

For the case where there is total emissions collection up to a design ambient wind speed, $V_D$, the tank vapor space pressure coefficient, $C_{PT}$, must be reduced by the emissions collection apparatus to a value at least as low as $-0.675$ so that air will flow into the tank vapor space through all of the tank wall vent holes. Using this value of $-0.675$ for the tank vapor space pressure coefficient, $C_{PT}$, Equation 1 may be integrated over the entire number of tank wall vent holes by using the measured tank wall vent hole pressure coefficients, $C_P$, that are shown in FIG. 3. Equation 3 is the resulting relationship which may be used to determine the total air/vapor mixture flow rate, $q_C$, that must be removed from the tank vapor space by the emission collection apparatus during standing storage.

$$q_C = 52.2 C_D A D V_D \quad (3)$$

where:

$q_C$ = total air/vapor mixture flow rate removed from the tank vapor space by the emissions collection apparatus during standing storage, (cubic feet per minute).

$C_D$ = discharge coefficient of a tank wall vent hole, (dimensionless).

A = flow area of the tank wall vent holes, (square feet per foot of tank diameter).

D = tank diameter, (feet).

$V_D$ = design ambient wind speed, (miles per hour).

As an illustration in the use of Equation 3, the following sample case is presented. Assume the following values for the variables $C_D$, A, D and $V_D$:

$C_D = 0.570$,

A = 0.200 square feet per foot of tank diameter,

D = 100 foot diameter, and $V_D = 10.0$ miles per hour.

Using these values for $C_D$, A, D and $V_D$, the total air/vapor mixture flow rate to be removed from the tank vapor space by the emissions collection apparatus during standing storage may be determined from Equation 3 to be 5,950 cubic feet per minute.

Since Equation 3 pertains to the emissions collection apparatus flow rate only during standing storage, it is necessary to consider the emissions collection apparatus flow rate required during tank working. When the tank is being filled with liquid product at a liquid product filling rate, $q_F$, in cubic feet per minute, the liquid will displace an equivalent flow rate of air/vapor mixture out of the tank vapor space. Thus, for tank working, the emissions collection apparatus flow rate must be the sum of the flow rate, $q_C$, determined from Equation 3 for standing storage and the liquid product filling rate, $q_F$.

The emissions collection apparatus can also be designed to operate with a variable air flow rate. During periods of low ambient wind speed, the flow rate through the emissions collection apparatus may be reduced while still achieving a total collection of emissions from the tank vapor space 52. This reduced collection flow rate may permit advantageous operation of the emissions abatement apparatus during periods of low ambient wind speed.

The emissions abatement apparatus 70 can be of conventional design, but will be sized so as to be of optimum efficiency for abatement of the amount of emissions released from the stored product 50 and the particular tank 20 design. The emissions abatement apparatus 70 consists of equipment capable of removing most or all of the emissions from the air/vapor mixture collected from the tank vapor space 52. The emissions abatement apparatus 70 may be one of several types of systems including but not limited to: (1) incineration (e.g. thermal incineration, catalytic incineration and regenerative thermal oxidation); (2) refrigeration; (3) absorption; and (4) adsorption. Kattan et al U.S. Pat. No. 3,979,175 discloses an abatement system which uses a solid adsorbent bed for adsorbing gasoline vapors which are then washed from the adsorbent bed by air and fed to a furnace for incineration. Such a system can be used in the present invention as the emissions abatement apparatus 70. Other abatement systems are disclosed in the prior art, such as Datis U.S. Pat. No. 3,972,201 which uses refrigeration.

An adsorption system has several advantages. The adsorbents are granular materials, such as activated carbon or molecular sieves, that are placed in a fixed bed. The emissions laden air passes through the bed, wherein the emissions are adsorbed on the bed materials. Adsorption systems typically have few moving parts, as compared to refrigeration systems. They are typically of low maintenance for tank owners and operators. They do not require the use of a fuel gas, such as natural gas, which is used in incineration systems.

A two-bed adsorption system has the advantage that when one bed becomes loaded or spent, operation can be quickly switched to the other bed to permit continuous operation. The spent bed can then be regenerated or re placed.

The concentration of emissions in the emissions collection apparatus of this invention is low. This has an advantage in that it reduces potential personal exposure to stock vapors, as well as eliminating the potential for forming combustible mixtures. The low concentration of emissions in the air being treated makes adsorption systems particularly attractive since they can achieve a high degree of emissions reduction or removal, even with low concentrations in the inlet air being treated.

The emissions abatement apparatus may include pretreatment and/or post-treatment steps. Examples of such steps might include, but are not limited to, condensers, desiccants, dehumidifiers, or other techniques to remove water vapor.

Additionally, some form of instrumentation could be installed to measure pollutant concentration(s). One embodiment would involve installing instrumentation at the outlet of the emissions abatement apparatus 70 to monitor the pollutant concentration(s) in the exhaust gas.

After the emissions laden air has been treated in the emissions abatement apparatus 70 the effluent is discharged to the atmosphere through vent stack 74.

The apparatus of this invention may be applied to multiple tanks. A single emissions collection apparatus can be designed to serve multiple tanks. It can be designed to include only a single induced draft blower, which can be connected to multiple tanks. Dampers or valves can be used to balance the flow rates from each tank to achieve proper ventilation of each tank.

Figure 8:
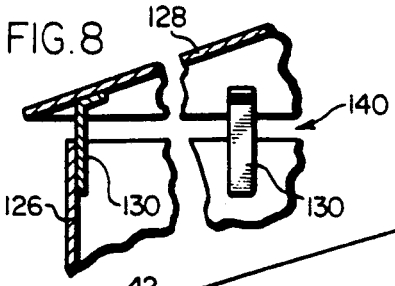
FIG. 8 is a sectional view of a portion of a tank having an air vent means in the form of a horizontal gap between the upper edge of the tank wall and the fixed roof.

FIG. 8 illustrates a second embodiment of the invention in which the air vent means constitutes a horizontal gap 140 formed by supporting the tank fixed roof 128 above the top edge of tank wall 126. A plurality of vertical metal bars or straps 130, desirably equally spaced apart, can be used to support the fixed roof. The lower portion of each bar 130 is joined to the upper portion of the tank wall 126 and the upper portion of each bar 130 is bent to provide a sloped load bearing portion which can be welded to the lower surface of fixed roof 128. The gap area between adjacent bars 130 can be treated as separate vent holes and thus they compare favorably in function to tank wall vent holes 40 in the tank wall 26.

The foregoing detailed description has been given for clearness of understanding only, and no unnecessary limitations should be understood therefrom, as modifications will be obvious to those skilled in the art.

What is claimed is:

1. A method of collecting and abating emissions from a volatile liquid in an above.ground storage tank;

the liquid storage tank having a bottom, a vertical cylindrical circular wall having a lower edge portion joined to the bottom, and an external fixed roof, the tank having an internal floating roof floating on a volatile liquid stored in the tank, and air vent means in the tank in communication with a vapor space in the tank constituting at least the space above the floating roof when the floating roof floats on a predetermined maximum volume of volatile liquid in the tank;

permitting ambient air to flow inwardly through the air vent means into the tank vapor space at an air flow rate under specified ambient wind speed conditions and tank operating conditions;

pumping emissions laden air from the tank vapor space above the floating roof by a conduit having an inlet end communicating with the tank vapor space, an outlet end communicating with the inlet end of an emissions abatement apparatus, and a pump means in the conduit for effecting said pumping and thereby delivering the emissions laden air to the emissions abatement apparatus; while simultaneously having air flow inwardly through the air vent means into the tank vapor space; and by means of the emissions abatement apparatus eliminating most of the emissions from the emissions laden air with formation of a gaseous effluent and then discharging the resulting gaseous effluent to the atmosphere.

2. A method according to claim 1 including:

controlling ambient wind flow inwardly through the air vent means into the tank vapor space at an air flow rate under specified ambient wind speed conditions and tank operating conditions by sizing and positioning the air vent means so that the mixture of air and emissions produced in the tank is not greater than a predetermined amount which the emissions abatement apparatus size or capacity can handle to remove, treat or destroy the emissions.

3. A method according to claim 1 in which:

the air vent means comprises a plurality of circumferentially positioned equally spaced apart continuously open air vent holes in and around the tank wall; and the air flows through the air vent holes into the tank vapor space.

4. A method according to claim 3 in which:

the vent holes are all of about the same size and shape and are located near the top of the tank wall in about a circumferential horizontal line.

5. A method according to claim 1 in which:

the emissions laden air is fed to an emissions collection apparatus sized so that, under all specified ambient wind speed conditions and tank operating conditions of standing storage and tank working, air flows inwardly through the air vent means into the tank vapor space.

6. A method according to claim 5 in which:

the emissions laden air is fed to an emissions collection apparatus sized so that the air flow rate into the tank vapor space is an approximate minimum needed to achieve a predetermined level of emissions collection so as to avoid unnecessarily increasing the size of the emissions abatement apparatus.

7. A method according to claim 5 in which:

the emissions laden air is fed to an emissions collection apparatus sized so that air will flow only inwardly through the air vent means into the tank vapor space so as to collect all emissions under all anticipated ambient wind speed conditions and tank operating conditions.

8. A method according to claim 1 in which:

the air flows into the tank vapor space through the air vent means sized so that a sufficient amount of air enters the tank vapor space to produce a noncombustible mixture when the emissions collection apparatus is not in operation.

9. A method according to claim 8 in which:

when the emissions collection apparatus is in operation a roof vent in the external fixed roof is closed and when the emissions collection apparatus is not in operation said roof vent is open.

10. A method according to claim 1 in which:

the emissions abatement apparatus comprises an incineration means, a refrigeration means, an absorption means or an adsorption means, to remove most of the emissions.

11. A method according to claim 1 in which:

the air vent means comprises a gap between the tank wall upper edge and the fixed roof.

12. A volatile liquid storage and emissions control apparatus comprising:

an above-ground volatile liquid storage tank having a bottom, a vertical cylindrical circular wall having a lower edge portion joined to the bottom, and an external fixed roof, the tank having an internal floating roof adapted to float on a volatile liquid to be stored in the tank, and air vent means in the tank located in communication with a vapor space in the tank constituting at least the space above the floating roof when the floating roof floats on a predetermined maximum volume of volatile liquid in the tank;

the air vent means permitting air to flow inwardly into the tank vapor space at an air flow rate under specified ambient wind speed conditions and tank operating conditions;

an emissions collection apparatus comprising a conduit having an emissions laden air inlet end communicating with the tank vapor space above the floating roof when the floating roof floats on a maximum volume of volatile liquid and an emissions laden air outlet end communicating with the inlet end of an emissions abatement apparatus, with said conduit including an induced draft blower for withdrawing emissions laden air from the tank vapor space and feeding it into the emissions abatement apparatus while simultaneously having air flow inwardly through the air vent means into the tank vapor space; and the emissions abatement apparatus comprising means for eliminating most of the emissions from the emissions laden air with formation of a gaseous effluent and discharging the resulting gaseous effluent to the atmosphere.

13. Apparatus according to claim 12 in which:

the air vent means comprises a plurality of spaced apart vent holes in the tank wall sized and positioned so that air can flow inwardly through the vent holes into the tank vapor space.

14. Apparatus according to claim 13 in which:

the vent holes are circumferentially positioned and equally spaced apart in and around the wall and the vent holes are continuously open.

15. Apparatus according to claim 14 in which the vent holes are all of about the same size and shape and are located near the top of the tank wall in about a circumferential horizontal line.

16. Apparatus according to claim 13 in which:

the number, size and position of the spaced apart vent holes is set so that air can flow inwardly through the vent holes into the tank vapor space at an air flow rate under specified ambient wind speed conditions and tank operating conditions which does not exceed production of a mixture of air and emissions greater than a predetermined amount to minimize the capacity or size of the emissions abatement apparatus to remove, treat or destroy the emissions.

17. Apparatus according to claim 12 in which the emissions collection apparatus is sized so that under all specified ambient wind speed conditions and tank operating conditions of standing storage and tank working, air will flow inwardly through the air vent means into the tank vapor space.

18. Apparatus according to claim 17 in which:

the emissions collection apparatus is sized so that the air flow rate into the tank vapor space is an approximate minimum needed to achieve a predetermined level of emissions collection so as to avoid unnecessarily increasing the size of the emissions abatement apparatus.

19. Apparatus according to claim 17 in which:

the emissions collection apparatus is sized so that air will flow only inwardly through the air vent means into the tank vapor space so as to collect all emissions under all anticipated ambient wind speed conditions and tank operating conditions.

20. Apparatus according to claim 12 in which:

the air vent means is sized and shaped so that a sufficient amount of air enters the tank vapor space to avoid a combustible air/vapor mixture in the tank vapor space when the emissions collection apparatus is not in operation.

21. Apparatus according to claim 20 in which:

the external fixed roof has a roof vent which is capable of closing when the emissions collection apparatus is in operation and of opening when the emissions collection apparatus is not in operation.

22. Apparatus according to claim 12 in which:

the emissions abatement apparatus includes incineration means, refrigeration means, absorption means or adsorption means to remove most of the emissions.

23. A storage apparatus according to claim 12 in which:

the air vent means comprises a gap between the tank wall upper edge and the fixed roof.

* * * * *